United States Patent [19]

Askew

[11] 4,099,895

[45] Jul. 11, 1978

[54] STRUCTURE FACILITATING FUEL PUMP ASSEMBLING

[75] Inventor: James Martin Anderton Askew, Brockworth, England

[73] Assignee: Lucas Industries Limited, Birmingham, England

[21] Appl. No.: 746,440

[22] Filed: Dec. 1, 1976

[30] Foreign Application Priority Data

Dec. 10, 1975 [GB] United Kingdom ..... 50559/75

[51] Int. Cl.[2] ..... F04B 7/04; F04B 39/10; F01B 29/08

[52] U.S. Cl. ..... 417/499; 123/139 AA; 92/128; 29/156.4 R

[58] Field of Search ..... 417/494, 499; 123/139 AA; 92/128, 129; 29/156.4

[56] References Cited

U.S. PATENT DOCUMENTS

| | | | |
|---|---|---|---|
| 2,079,821 | 5/1937 | Scribner | 92/129 |
| 2,322,356 | 6/1943 | Hahn | 417/494 |
| 2,513,883 | 7/1950 | Male | 417/499 |

FOREIGN PATENT DOCUMENTS

| | | | |
|---|---|---|---|
| 434,328 | 4/1948 | Italy | 417/494 |

*Primary Examiner*—Carlton R. Croyle
*Assistant Examiner*—Thomas I. Ross

[57] ABSTRACT

A fuel pumping apparatus includes a plunger which passes centrally through an annular member and is movable axially relative to the member. The plunger is connected to the member so that angular movement of the member will impart angular movement to the plunger by means of a dog which passes within a slot formed in the member. The plunger is loaded outwardly by means of a strong spring and during assembly of the device it is necessary to compress the spring and align the dog with the slot continuing the compression of the spring when such alignment is obtained. This task is not easy but is facilitated by relieving one end surface of the member adjacent one side of the slot over an area such that alignment of the dog with the surface is compartively easy. During compression of the spring and movement of the plunger the dog will engage with said surface. When this has happened the pressure is eased slightly and the member moved angularly so that a side surface of the dog engages the side surface of the slot opposite the relieved portion of the member. Further compression of the spring can then take place.

4 Claims, 4 Drawing Figures

STRUCTURE FACILITATING FUEL PUMP ASSEMBLING

This invention relates to fuel pumping apparatus of the kind comprising a body, a bore defined in the body or a part mounted therein, a reciprocable plunger mounted within the bore, the angular setting of said plunger determining the amount of fuel delivered by the apparatus during a delivery stroke, an annular angularly adjustable member surrounding a portion of the plunger which extends from the bore, an open ended slot defined in said member, a lateral dog on the plunger engaging in said slot, the side walls of said slot engaging with the side walls of the dog to determine the angular setting of the plunger, a head at the end of the projecting portion of the plunger, a coiled compression spring and a spring abutment plate engaging the spring and head to urge the plunger in the direction out of the bore.

During assembly of the apparatus the spring must be compressed a pre-determined extent and it is necessary before such compression can occur, to ensure that the dog is aligned with the slot because during compression of the spring the dog moves along the slot. Such alignment is not easy because the side walls of the dog and slot have only limited clearance to minimise the degree of back-lash between the member and the plunger. The object of the invention is to provide an apparatus of the kind specified in which the aforesaid alignment is facilitated.

According to the invention in an apparatus of the kind specified the end face of the member of the presented end face of the dog is relieved over an area adjacent one of the side walls of the respective component, said area being of a size to facilitate alignment whereby in use, the plunger is moved into the bore until said relieved face is engaged by the other end face whereafter the engaging pressure is relaxed and the angularly adjustable member is moved angularly so as to bring a side wall of the slot into engagement with a side wall of the dog thus accurately aligning the dog with the slot so as to permit further compression of the spring.

Figure 1:
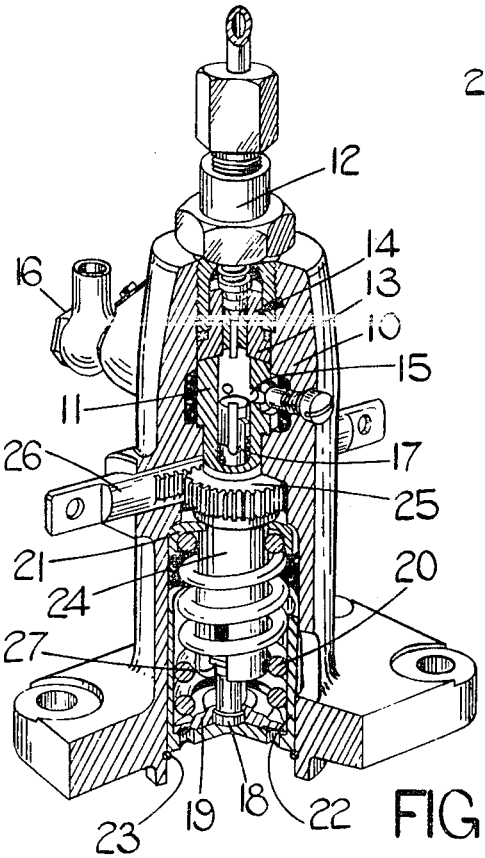
Figure 2:
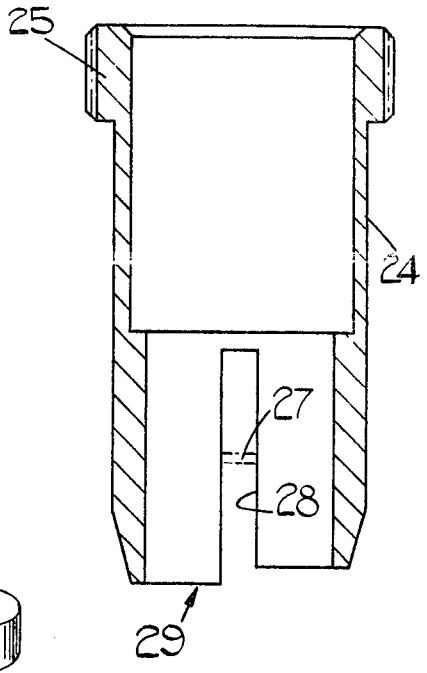
Figure 3:
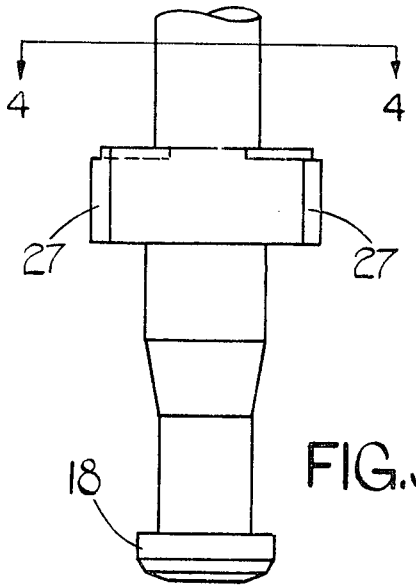
Figure 4:
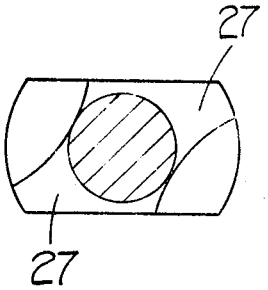

One example of a fuel pumping apparatus to which the invention may be applied will now be described with reference to the accompanying drawings in which FIG. 1 is a cut away perspective view of the apparatus, FIG. 2 is a side elevation to an enlarged scale of a portion of the apparatus of FIG. 1, FIG. 3 is a side view to an enlarged scale showing an alternative arrangement and FIG. 4 is a sectional plan view on the line 4—4 of FIG. 3.

Referring to the drawings the apparatus comprises a housing 10 in which is located a pump barrel 11. The barrel 11 is of stepped form and is located against a step defined in the housing. The barrel is retained within the housing by a plug 12 and intermediate the plug 12 and the barrel 11 has a flange 13 which forms part of the housing of a delivery valve 14. The plug 12 also defines a fuel outlet.

The barrel 11 is provided with a cylindrical bore and opening into the bore is an inlet port 15 which is supplied with fuel from a gallery surrounding the barrel and communicating with an external source of fuel by way of an inlet 16.

Located within the bore is a plunger 17 and this is provided in known manner, with a helical edge whereby the angular setting of the plunger determines the amount of fuel which is supplied through the outlet when the plunger is moved in the direction towards the delivery valve.

The plunger at its opposite end, is provided with a head 18 upon which is mounted a spring abutment plate 19 which engages one end of a coiled compression spring 20. The other end of the coiled compression spring is located against a further abutment member 21 which engages a wall of the housing. Moreover, the abutment plate 19 and the head 18 of the plunger engage the base wall of a tappet 22 slidable within the housing and secured within the housing by means of a spring ring 23. In use, the tappet is engaged by a cam to effect inward movement of the plunger.

Located about the barrel is an annular member 24 which surrounds in spaced relationship, a portion of the plunger extending from the barrel. The member 24 is provided with a gear segment 25 and this is engageable by a rack bar 26 whereby the angular setting of the member 24 can be adjusted.

The plunger 17 is provided with a pair of diametrically disposed dogs 27 and these are located within axially extending and diametrically disposed slots formed in the member 24. The slots therefore permit relative axial movement between the plunger and the member but angular movement of the member 24 is transmitted to the plunger so that the amount of fuel which is delivered through the outlet at each injection stroke can be adjusted.

One of the problems with the apparatus described occurs during assembly. The spring 20 has substantial strength and frequently it is necessary to utilise a tool to compress the spring. With the tappet in position it is no longer possible to observe the engagement of the dogs with the slots and unless great care is taken it is possible to exert considerable force between the dogs and the end face of the member which can result in damage. Alignment is particularly difficult because the side faces of the slots and the side faces of the dogs have only a very small clearance to minimise back-lash between the plunger and the member.

In order to facilitate engagement and as shown in FIG. 2, the end face 29 of the member 24 is relieved on one side of the slot 28. It will of course be appreciated that since there are two slots two portions of the end face 29 are relieved. The extent of relief is substantial so that during assembly of the apparatus above the alignment of the plunger before compression of the spring will more or less guarantee that the end faces of the dogs 27 engage with the relieved portions of the end face 29.

Once the resistance to continued compression of the spring is felt, the pressure is relaxed slightly and the member 24 moved angularly until the dog engages the side wall of the slot 28 which is opposite the relieved portion. When this has occurred the person assembling the apparatus knows that the dogs 27 are aligned with the slot 28 and continued compression of the spring can take place to permit the spring ring 23 to be inserted in its groove thereby to retain the parts of the apparatus in the position in which they are shown in FIG. 1.

FIGS. 3 and 4 show an alternative arrangement in which it is the end faces of the dogs 27 which are relieved. The mode of assembly is exactly the same.

With the arrangements described while it is still necessary to take care to ensure that undue pressures are not exerted on the various components the alignment of the various parts is greatly facilitated.

I claim:

1. A fuel pumping apparatus comprising a body, a bore defined in the body, a reciprocable plunger mounted within the bore and having a portion extending from the bore, means for adjusting the angular setting of said plunger in the bore, said means comprising an annular angularly adjustable member surrounding said portion of the plunger and having side walls defining an open ended slot in said member, a lateral dog on the plunger engaging in said slot, the side walls defining said slot engaging with the side walls of the dog to determine the angular setting of the plunger, a head at one end of the plunger, a coiled compression spring, a spring abutment plate engaging the spring and head to urge the plunger in the direction out of the bore, the end face of the member being relieved over an area adjacent one of the side walls of the dog, said area being of a size to facilitate alignment of said plunger and said member whereby during assembly the plunger is moved into the bore until said relieved face of said member is engaged by the end face of the dog whereafter the engaging pressure is relaxed and the angularly adjustable member is moved angularly so as to bring a side wall defining the slot into engagement with a side wall of the dog thus accurately aligning the dog with the slot so as to permit further compression of the spring.

2. An apparatus according to claim 1 in which said plunger is provided with a pair of diametrically disposed dogs and the member is provided with a pair of slots to receive said dogs respectively, the end face of said member having two relieved areas.

3. A fuel pumping apparatus comprising a body, a bore defined in the body, a reciprocable plunger mounted within the bore and having a portion extending from the bore, means for adjusting the angular setting of said plunger in the bore, said means including an annular angularly adjustable member surrounding said portion of the plunger and having side walls defining an open ended slot in said member, a lateral dog on the plunger engaging in said slot, the side walls defining said slot engaging with the side walls of the dog to determine the angular setting of the plunger, a head at one end of the plunger, a coiled compression spring, a spring abutment plate engaging the spring and head to urge the plunger in the direction out of the bore, the end face of the dog being relieved over an area adjacent one of the side walls defining the slot, said area being of a size to facilitate alignment of said plunger and said member, whereby during assembly the plunger is moved into the bore until said relieved face of said dog is engaged by the end face of the member whereafter the engaging pressure is relaxed and the angularly adjustable member is moved angularly so as to bring a side wall defining the slot into engagement with a side wall of the dog thus accurately aligning the dog with the slot so as to permit further compression of the spring.

4. An apparatus according to claim 3 in which said plunger is provided with a pair of diametrically disposed dogs and the member is provided with a pair of slots to receive said dogs respectively, each of said dogs having a relieved end face.

* * * * *